United States Patent [19]

Twomey et al.

[11] Patent Number: 4,906,199

[45] Date of Patent: Mar. 6, 1990

[54] SHIELD GROUNDING CONNECTOR AND METHOD

[75] Inventors: Robert C. Twomey, Los Angeles; Jan A. Kilsdonk, Corona; Lawrence Schwartz, Huntington Beach, all of Calif.

[73] Assignee: McDonnell Douglas Corporation, Long Beach, Calif.

[21] Appl. No.: 246,084

[22] Filed: Sep. 19, 1988

[51] Int. Cl.[4] ..... H01R 4/66

[52] U.S. Cl. ..... 439/95; 439/108; 439/607; 29/857

[58] Field of Search ..... 439/607, 608, 609, 610, 439/92, 95, 96, 98, 107, 108, 97, 578, 579, 580, 581; 29/857

[56] References Cited

U.S. PATENT DOCUMENTS

| | | | |
|---|---|---|---|
| 2,761,110 | 8/1956 | Edlen et al. | 439/581 |
| 3,848,164 | 11/1974 | Otte | 439/610 X |
| 4,734,046 | 3/1988 | McAllister et al. | 439/581 X |

OTHER PUBLICATIONS

Expert from ITT Cannon Catalog, "BKAD/E/F-/C-ARINC 600 Series", pp. 1-4.

*Primary Examiner*—Neil Abrams
*Assistant Examiner*—Khiem Nguyen
*Attorney, Agent, or Firm*—Curt L. Harrington; George W. Finch; John P. Scholl

[57] ABSTRACT

A device and method facilitates grounding shielding, including hardware and structures necessary to allow proper connection, practice the steps of the method, minimize pigtail length, facilitate the formation of a wire bundle assembly, facilitate repair and installation, and result in materials and labor savings.

13 Claims, 4 Drawing Sheets

SHIELD GROUNDING CONNECTOR AND METHOD

BACKGROUND OF THE INVENTION

Industry has long used various types of electrical wiring and interconnects. These frequently employ shielding which covers the individual wires. This shielding is intended to provide an electromagnetic barrier between the shielded wire and other wires or the electromagnetic environment. These shields cannot perform their intended function if they are not electrically teminated in a mechanically and electrically suitable manner.

Shielding a permanent section of line can be accomplished in a cost effective manner during the manufacturing operation. However, where connectors are concerned, it may be mechanically convenient to break the grounding shield to facilitate connection and reintroduce the shield on the other side of the connector. This produces a gap in the shields covering of the wire bundle, and thus degrades the ground shield's electrical effectiveness.

Presently, the wire grounding hardware will usually consist of grounding studs such as a screw, nut and washer, which must be mounted on an adequately conductive surface. The grounding wire is terminated in lugs with a round hole which must be placed over the ground stud screw and held in place using the nut and washer. Assembly requires larger working space and good dexterity. For reasons of mechanical access, the ground stud must usually be located a minimum of several inches from its associated electrical connector.

Other methods utilize a special back shell for the electrical connectors. These are an improvement on ground studs, but the method of mechanically terminating the wire or shield in these special back shells differs from the method used to terminate the wires at the connector. The use of the back shell requires special training and handling practices and procedures. Disassembly and reassembly of these grounded connections for repair or trouble shooting is very difficult.

Normally when the shield is interrupted, the ground shield is grounded to the support structure, which in aerospace applications is typically an airframe. The length of the connection from the ground shield interrupt to the airframe, also known as the pigtail, is an important consideration. Long pigtails and poorly chosen grounding points can seriously degrade the ground shielding to the point of negating the usefulness of the ground shield.

SUMMARY OF THE INVENTION

The device and method for grounding of the present invention provides a proper grounding termination for a wide variety of grounding. The device and method disclosed herein can be utilized and fully implemented in wire termination hardware of many types.

The device and method of the present invention holds the pigtail to the minimum necessary to allow for the proper grounding connection and, indeed, facilitates the availability of that shorter length. In most cases, the use of the invention will allow limitation of the pigtail to no longer than the length of the unshielded main connector through the connector.

The device and method of the present invention also facilitates wire bundle assembly, of which the shielded wire is a part, to flex more freely about the rear area of the connector. Alternately, the wire bundle can be moved with the connector for ease of assembly, installation and repair because it is now free of the grounding connection to a fixed ground frame surface.

An important practical aspect of the invention is use of commonly available electrical disconnect devices and tooling usually identical to those used to terminate the wires in the connector. Aside from the basic shield grounding plate assembly of the invention, no new parts, tools or training methods are required to implement the apparatus and method of the present invention. Therefore, the resulting system will be user friendly and electromechanically effective. The use of the present invention will result in materials and labor savings and offer greater utility to the electrical connector environment.

BRIEF DESCRIPTION OF THE DRAWINGS

The structure and method of operation of the invention, together with additional advantages thereof, will be best understood from the following description of specific embodiments when read in connection with the accompanying drawings, in which.

DETAILED DESCRIPTION OF THE PREFERRED EMBODIMENT

Figure 1:
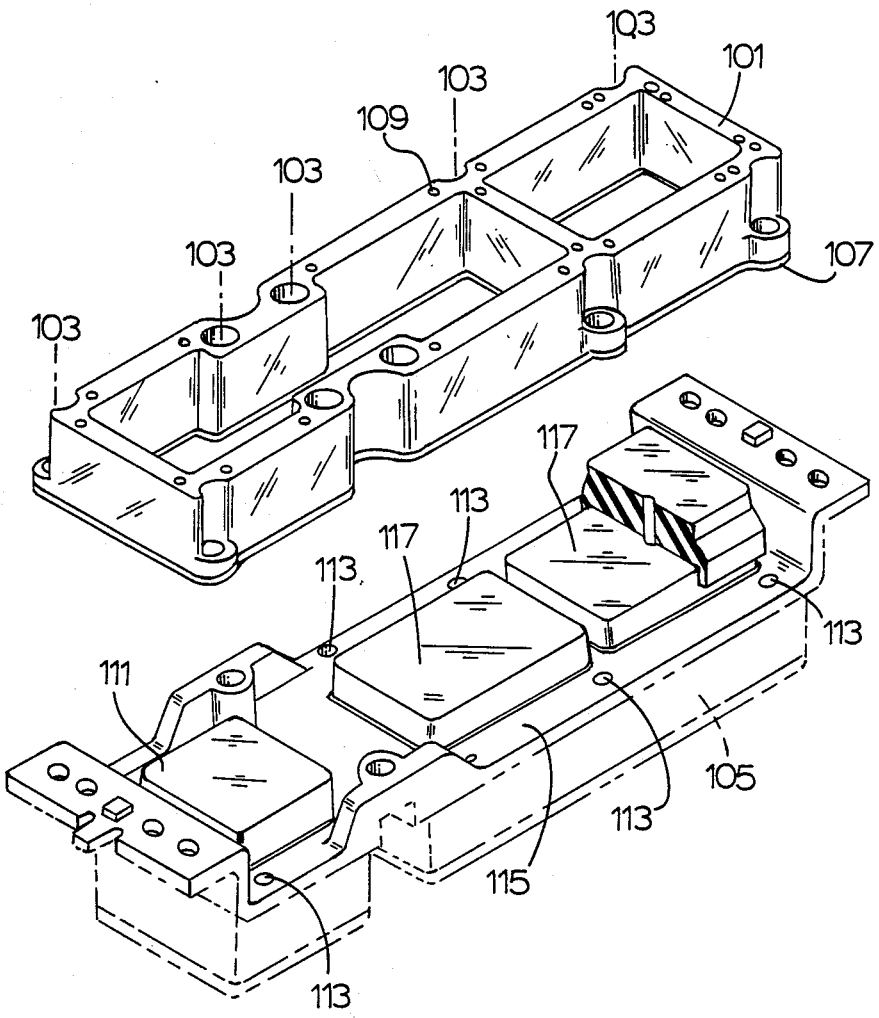
FIG. 1 is an isometric view of the mating parts of a typical connector utilizable in implementing the present invention.

Referring to FIG. 1, an isometric view of the mating parts of a tyical connector utilizable in implementing the present invention is shown. A shield grounding block 101 is shown in elevated position. Mounting holes 103 are provided for the attachment of shield grounding block 101. Isometrically above shield grounding block 101 is a connector 105.

For the attachment of shield grounding block 101 to connector 105, shield grounding block 101 is provided with a grounding plate and insert retainer 107. Further, shield grounding block 101 has a grounding contact cavity 109. Connector 105 has a power contact insert 111. Connector 105 has a threaded hole 113 to anchor the shield grounding block 101. A grounding aperture 115 is provided on connector 105 to enable the grounding potential to be accepted by connector 105. Also on connector 105 is located a signal contact cavity 117.

Figure 2:
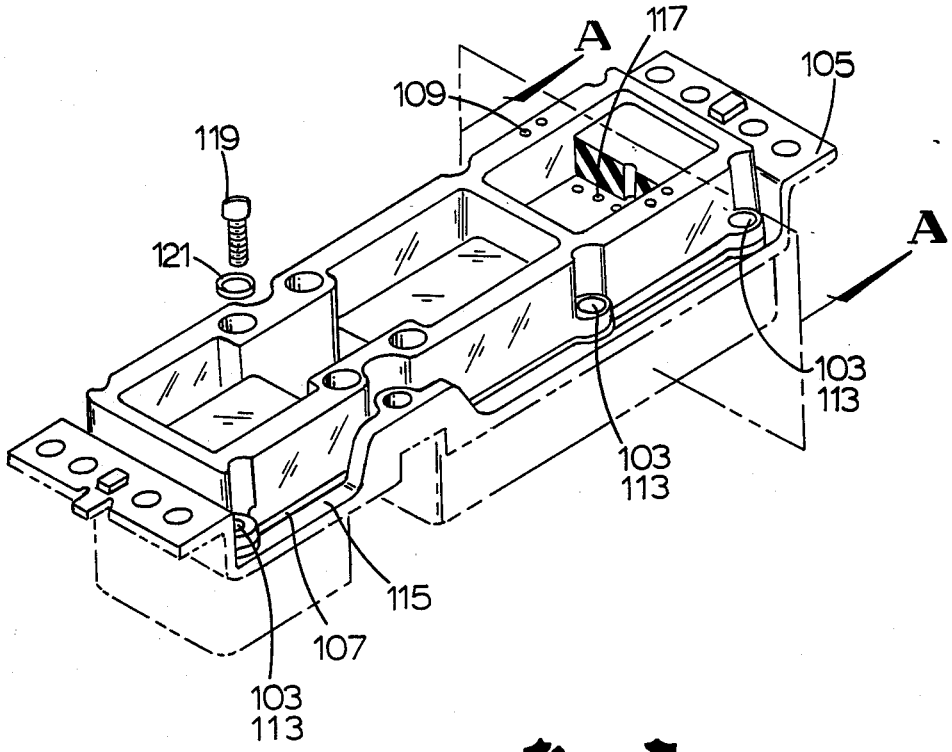
FIG. 2 is an isometric view of the connector of FIG. 1 in mated alignment.

Referring to FIG. 2, an isometric view of a shield grounding block connected to a typical connector as was illustrated in FIG. 1 is shown. Into grounding shield block 101 a typical mounting screw 119 is inserted through a typical lock washer 121. A multiplicity of these are used to join shield grounding block 101 to connector 105 at various points about their peripherae.

Figure 3:
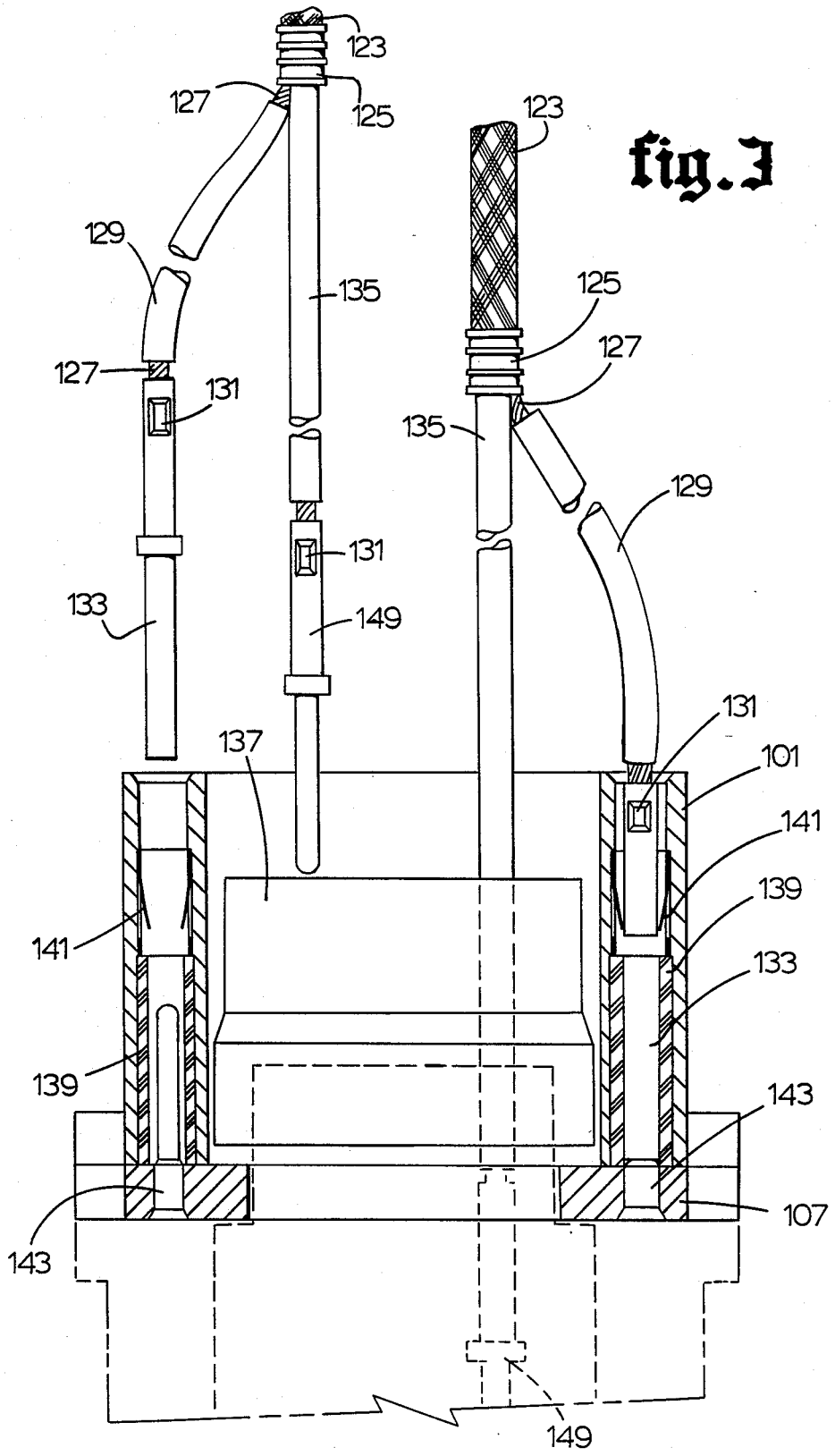
FIG. 3 is a side view of a shielded wire approaching the electrical connector of FIGS. 1 and 2 illustrating the method of grounding attachment.

Referring to FIG. 3, a side view of a shielded wire approaching the electrical connector of FIGS. 1 and 2 illustrating the method of grounding attachment is shown. A shielded wire 123 extends from a point outside of FIG. 3, downward. Shielded wire 123 can have any type of shielding, but will normally have a braided shielding as is illustrated. A shield crimp termination 125 is illustrated on shielded wire 123 at the point of shielding termination. Electrically attached to crimp termination 125 is a grounding conductor 127. Grounding conductor 127 will typically have an insulated section 129. Grounding conductor 127 typically terminates in a crimp end 131 of a socket contact 133.

The conductor which is shielded up to shield crimp termination 125 will be referred to as signal wire 135, although this line need not necessarily carry a signal. Signal wire 135 also terminates in a crimp end 131 of a pin contact 149. Upon installation, pin contact 149 will extend through a connector insert 137. This condition is illustrated in the right half of FIG. 3. Pin contact 149 is illustrated as well within connector insert 137.

Referring to the left half of FIG. 3, a retainer bushing 139 is shown below and parallel to socket contact 133. Immediately above retainer bushing 139, a retainer clip 141 is shown. Below retainer bushing 139, a grounding pin 143 is shown. At the right hand side of FIG. 3, pin contact 149 is shown inserted into retainer bushing 139 and held in place by retainer clip 141, acting against the raised radial land portion of socket contact 133.

Figure 4:
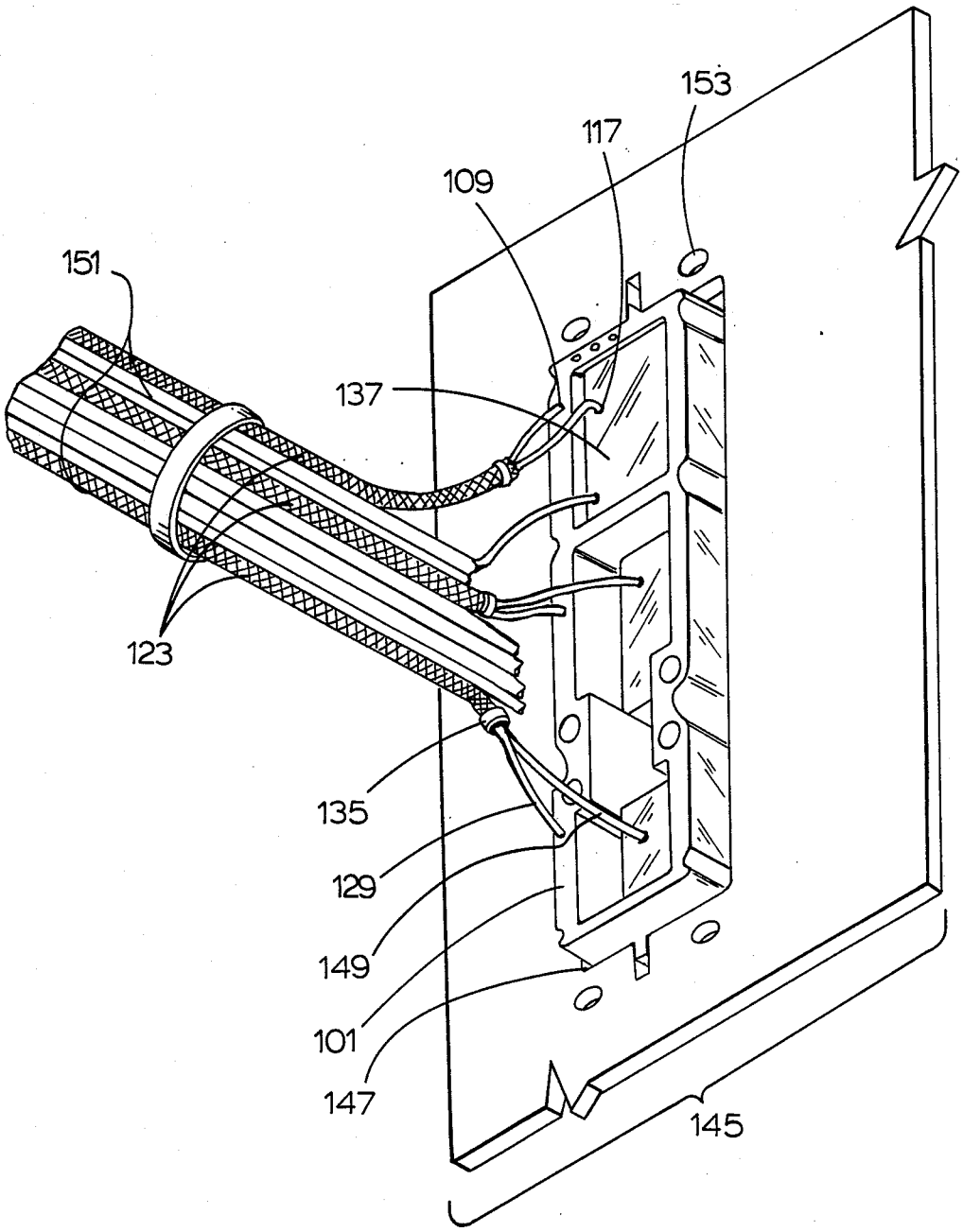
FIG. 4 is an isometric view of a typical wire bundle connected to the typical connector of FIG. 1.

Referring to FIG. 4, an isometric view of a typical wire bundle connected to the typical connector of FIG. 1 is shown. An avionic rack section 145 is shown as a point of reference. To the avionic rack section 145 is attached connector 105 to which is attached the shield grounding block 101 shown on FIGS. 1-3. Shield grounding block 101 extends through a cut-out portion 147 of avionic rack 145. A typical cable harness 151 is shown entering the perspective of FIG. 4 from the upper left hand corner. This harness 151 contains many wires, among which are several shielded wires 123.

FIG. 4 illustrates the grounding connection of three shielded wires 123. Note that the shield grounding pigtail 129 of each shielded wire 123 is connected to a point about the periphery of shield grounding block 101, while the signal wire 135 is connected nearer the center, through one of the connector inserts 137. Shield grounding block 101 is held in place on avionic rack section 145 by a pair of connector mounting holes 153 located at the top and bottom of avionic rack section 145.

The forgoing disclosure and description of the invention are illustrative and explanatory thereof, and various changes in the size of the grounding block 101, orientation of the wiring, materials of construction, physical configuration, and changes to effect the desired electromagnetic performance characteristics to be achieved, as well as in the details of the illustrated embodiments, may be made without departing from the spirit and scope of the invention.

What is claimed is:

1. A grounding device comprising:

grounding block means, having at least one grounding contact cavity about its periphery, for accepting a grounding shield connection;

connector means, connected to said block means, for electrically joining with said block means, and having at least one signal contact cavity;

grounding contact means, within said grounding contact cavity, for accepting a conductively grounded potential;

signal contact means, within said signal contact cavity, for accepting a conductively non-grounded potential, said grounding block means having no signal contact means, and said connector means having no grounding contact means.

2. The grounding device of claim 1 wherein said grounding block means comprises a shield grounding block having generally rectangular thick walls, having at least one open area extending completely therethrough, said grounding contact means disposed within said walls and generally extending into said walls along a path coaxial with the axis of said open area.

3. The grounding device of claim 1 wherein said connector means comprises a connector mateable with said block means and having at least one generally planar raised face signal contact area, each said signal contact area having at least one signal contact means.

4. The grounding device of claim 2 wherein said connector means comprises a connector mateable with said shield grounding block and having at least one generally planar raised face signal contact area, each said signal contact area having at least one signal contact means, said connector mateable with and securable to said shield grounding block.

5. The grounding device of claim 4 wherein said grounding contact means further comprises:

an annularly shaped retainer bushing, having a first open end, a second open end, and an inner surface, disposed in said wall of said shield grounding block and coaxial with the axis of said open area;

a grounding pin having a base end and an elongate rounded end, and coaxial with said retainer bushing, said elongate rounded end located within, and radially equidistant from the inner surface of said annularly shaped retainer bushing; and, a retainer clip, generally annularly shaped, having an inner wall, an outer wall, first open end, a second open end, and having a multiplicity of projections extending from a point on the wall of said retainer clip nearer said first open end to a point of termination radially inward from said inner wall nearer said second open end of said retainer clip.

6. A ground shielding assembly, including the ground shielding device of claim 5, and further comprising:

at least one signal conductor extending toward said shield grounding block;

a grounding conductor generally surrounding said signal conductor;

a grounding conductor termination structure electrically connected to said grounding conductor a pigtail grounding conductor electrically connected to said grounding conductor termination structure;

a grounding socket contact having a crimp end and an open annular end and a raised radial land nearer the axial center, said grounding socket connected to said pigtail grounding conductor at said crimp end, said grounding socket fittable within said retainer clip and said retainer bushing and said open annular end fittable over said elongate rounded end of said grounding pin, the points of termination of said multiplicity of projections of said retainer clip retainably engageable with said raised radial land; and, a signal pin contact having a crimp end and a closed cylindrical end and a raised radial land nearer the axial center, said signal pin contact connected to said signal conductor at said crimp end, said signal pin fittable within said signal contact means.

7. The ground shield assembly of claim 6 wherein said signal pin contact is conductively inserted into said signal contact means and wherein said grounding socket contact is conductively inserted within said grounding contact means.

8. The ground shield assembly of claim 7 wherein said signal contact means comprises a signal contact cavity mateable in electrical contact with said signal pin contact.

9. A grounding shield assembly comprising:

a shield grounding block having a generally rectangular thick walls, having at least one open area extending completely therethrough;

an annularly shaped retainer bushing, having a first open end, a second open end, and an inner surface, disposed in said wall of said shield grounding block and coaxial with the axis of said open area;

a grounding pin having a base end and an elongate rounded end, and coaxial with said retainer bushing, said elongate rounded end within and radially equidistant from the inner surface of said annularly shaped retainer bushing; and, a retainer clip, generally annularly shaped, having an inner wall, an outer wall, first open end, a second open end, and having a multiplicity of projections extending from a point on the wall of said retainer clip nearer said first open end to a point of termination radially inward from said inner wall nearer said second open end of said retainer clip;

a connector in mated contact with said shield grounding block and having at least one generally planar raised face signal contact area, each said signal contact area having at least one female socket;

at least one signal conductor extending toward said shield grounding block;

a grounding conductor generally surrounding said signal conductor;

a grounding conductor termination structure electrically connected to said grounding conductor a pigtail grounding conductor electrically connected to said grounding conductor termination structure;

a grounding socket contact having a crimp end and an open annular end and a raised radial land nearer the axial center, said grounding socket connected to said pigtail grounding conductor at said crimp end, said grounding socket fittable within said retainer clip and said retainer bushing and said open annular end fittable over said elongate rounded end of said grounding pin, the points of termination of said multiplicity of projections of said retainer clip retainably engageable with said raised radial land; and, a signal pin contact having a crimp end and a closed cylindrical end and a raised radial land nearer the axial center, said signal pin contact connected to said signal conductor at said crimp end, said signal pin fitted within said female socket of said connector.

10. The grounding shield assembly, as recited in claim 9, wherein said connector has at least one aperture for mounting on a generally planar support structure.

11. The grounding shield assembly, as recited in claim 9, wherein said connector has two generally planar raised face signal contact areas to facilitate the transmission of data and one generally planar raised face signal contact area to facilitate the transmission of power.

12. The process of providing ground shielding at a junction point comprising the steps of:

forming a shield crimp termination near the end of a shielded wire having a signal conductor and a groundable shielding, said crimp termination in electrical contact with said groundable shielding on said shielded wire;

electrically connecting one end of a grounding pigtail wire to said shield crimp termination and the other end of said grounding pigtail wire to the crimp end of a socket contact;

electrically connecting the end of said signal conductor to a pin contact;

inserting said socket contact into one of the peripheral grounding contact cavities of a shield grounding block;

mating said shield grounding block with a connector to provide electrical contact from said signal conductor and said groundable shielding through to said connector; and, inserting said pin contact into a signal contact cavity of said connector.

13. The process of providing ground shielding at a junction point, as recited in claim 12, further comprising the step of grounding the grounding potential from said connector.

* * * * *